United States Patent [19]

Joris

[11] 4,073,430

[45] Feb. 14, 1978

[54] MAILBOX SIGNAL

[76] Inventor: Albert P. Joris, 80 Maple St., White Cloud, Mich. 49349

[21] Appl. No.: 735,800

[22] Filed: Oct. 26, 1976

[51] Int. Cl.[2] ..... B65D 91/00

[52] U.S. Cl. ..... 232/35; 16/159

[58] Field of Search ..... 232/34, 35; 16/135, 16/159, 191

[56] References Cited

U.S. PATENT DOCUMENTS

| | | | |
|---|---|---|---|
| 719,832 | 2/1903 | Miller | 16/159 |
| 761,338 | 6/1904 | Bevan | 232/35 |
| 968,151 | 8/1910 | Harmon | 232/34 |
| 2,815,167 | 12/1957 | Bailes et al. | 232/35 |
| 3,291,386 | 12/1966 | Van Fleet | 232/35 |
| 3,586,235 | 6/1971 | Fishel | 232/35 |
| 3,589,329 | 6/1971 | Schuh | 232/35 |
| 3,904,108 | 9/1975 | File | 232/35 |
| 3,958,752 | 5/1976 | Pieszchala | 232/35 |

*Primary Examiner*—Roy D. Frazier
*Assistant Examiner*—Peter A. Aschenbrenner
*Attorney, Agent, or Firm*—Price, Heneveld, Huizenga & Cooper

[57] ABSTRACT

A mailbox signaling device for rural mailboxes for indicating when the mailbox has been opened to insert delivered mail or retrieve outgoing mail. The device, which is preferably supplied in kit form for do-it-yourself installation, includes a signaling member, preferably including a portion coated with high visibility paint, pivotally secured to the mailbox for swinging movement between raised and lowered positions and a flexible connector extending from the signaling member, through the mailbox interior, to a releasable connection at the door of the mailbox. Opening the door releases the connector allowing the signaling member to fall indicating such door opening.

18 Claims, 6 Drawing Figures

MAILBOX SIGNAL

BACKGROUND OF THE INVENTION

This invention relates to a signaling device adapted for use on mailboxes, and especially rural mailboxes, for indicating from a distance when the mailbox door has been opened which is typically when the mailman has arrived to deliver or pick up mail. The signal, therefore, prevents unnecessary trips to the mailbox before arrival of the mailman.

Mailbox signals of varying types and arrangements are well known. Although many prior constructions have been offered and even patented, it is the rare signaling device which incorporates the combined features of reliable signaling, coupled with durable yet simple and inexpensive construction. A basic object is, therefore, to provide reliable signaling especially where the signal has a high visibility and can easily be seen to determine whether the signal has been moved. In many prior signals, the structure has been so complex that such reliable signaling cannot be assured. Also, many of these structures have been susceptible to the effects of weather and have had short life spans or have required frequent repair or even replacement.

It is often the case that rural mailboxes are secured together in closely adjacent spaces next to one another to provide centralized delivery. In such instances, it is a particular requirement that the signal operates successfully upon each opening of the door to the mailbox in a manner which does not affect the operation of adjacent signals. That is, the signal must operate without causing or triggering the premature release of adjacent signals.

The purpose of the present invention is, therefore, to overcome the above problems and provide a reliable, simple and yet inexpensive signal device which is highly visible when installed on a rural mailbox and therefore is easily viewed for an indication of the opening of the door. Further, the present invention successfully operates each time the door is opened and does not affect or trigger adjacent mailbox signals should the mailbox including the signal be secured in close relationship to another.

SUMMARY OF THE INVENTION

Accordingly, the present invention provides a mailbox signaling device which is simple to install and operate, extremely reliable in operation and yet inexpensive to manufacture. The signaling device is preferably provided in kit form and adapted for inclusion on mailboxes and mail receptacles of a wide variety such as those including top, side, end and bottom portions as well as a closure movably mounted over an aperture in the receptacle for access to the receptacle interior. The device includes a signaling member pivotally mounted preferably to either the back or the rear of one side of the mailbox or receptacle near the bottom thereof. An elongated, flexible connector is provided extending through the interior of the receptacle along with means for mounting the connector for sliding movement through one portion of the receptacle from interior to exterior thereof. First means are provided for attaching one of the ends of the connector to the signaling member at a location spaced along the signaling member from its pivot point. Second means are included for releasably securing the other end of the connector to an interior surface of the receptacle closure or door such that when the closure or door is opened, the flexible connector will be released.

The connector itself has an overall length and strength sufficient to hold the signaling member in a visible position such that at least a portion is visible above the top of the receptacle or mailbox when the releasable second means is secured to the interior surface of the door or closure when the door is in its closed position. Thus, when the closure is open, the second means releases the connector allowing the signal means to pivot downwardly to a fallen or lowered position indicating that the closure has been opened.

Means may be included to support the signaling member in its lowered position as well as means for preventing the member from impacting with a large force on such a support member. A particular advantage of the present invention is the high visibility of the signaling member which is preferably elongated with a high visibility disc at the upper end thereof. This member swings through a large radius arc. The raised and lowered positions of the signal can therefore be easily distinguished. When lowered, the signaling member fits compactly along the side or back of the mailbox so as not to interfere with insertion of mail in or removal of mail from the receptacle or with movement around the box. The release mechanism allowing the member to fall to its lowered position is extremely reliable and is virtually unaffected by weather unlike many prior known structures. Moreover, the structure may include means which prevent the pivoting of the signal member past the vertical such that when the member is applied to the rear of a mailbox, it cannot fall in a direction opposite to that which is intended. Adjacent signals on closely adjacent mailboxes are, therefore, not disturbed.

These and other objects, advantages, purposes and features will become more apparent from a study of the following description taken in conjunction with the drawings.

DESCRIPTION OF THE PREFERRED EMBODIMENT

Figure 1:
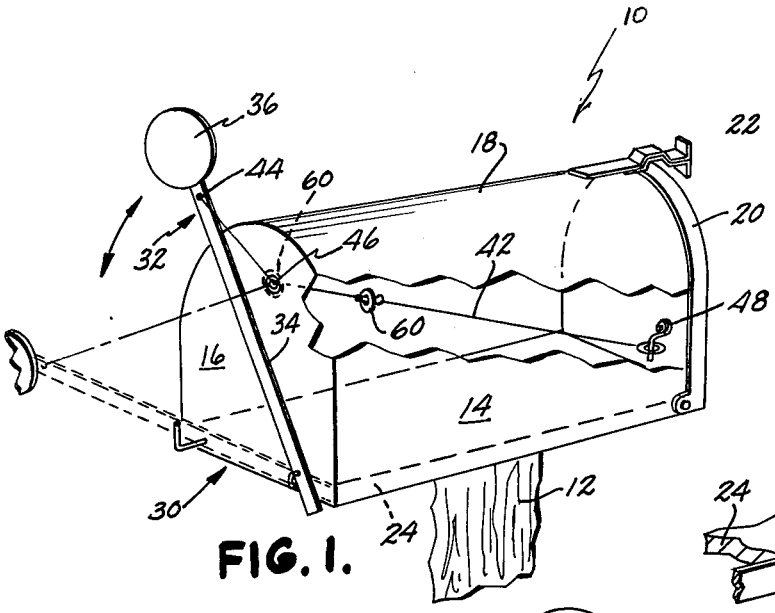
FIG. 1 is a perspective view of a typical rural mailbox with portions broken away to reveal the structure of the present signaling device which is shown applied to a rear portion of the mailbox.
Figure 6:
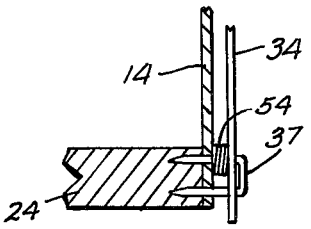
FIG. 6 is a fragmentary end elevation taken partially in cross section along line VI—VI of FIG. 2 illustrating the pivotal attachment of the signaling member to the mailbox.
Figure 5:
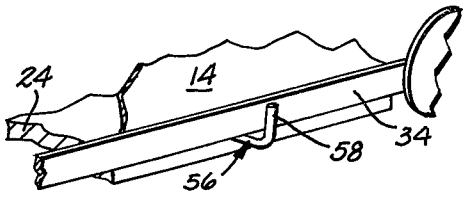
FIG. 5 is a fragmentary, perspective view of the support member for the signaling member in its lowered position.

Referring now to the drawings in greater detail, FIG. 1 illustrates a typical rural mailbox 10 supported above the ground surface on a support post 12. The mailbox includes sides 14, a rear or end surface 16, a top or roof 18 and a movable door or closure 20 at the end opposite the rear end 16. Door 20 is typically pivotally mounted, in this case at the bottom of the mailbox such that it swings outwardly and downwardly, and includes a latch member 22 at the upper end for retaining the door in its closed position. The bottom of the mailbox 24 is typically formed from a wooden board over which the sheet metal sides, end and door closures are fitted as shown in the drawings.

Figure 2:
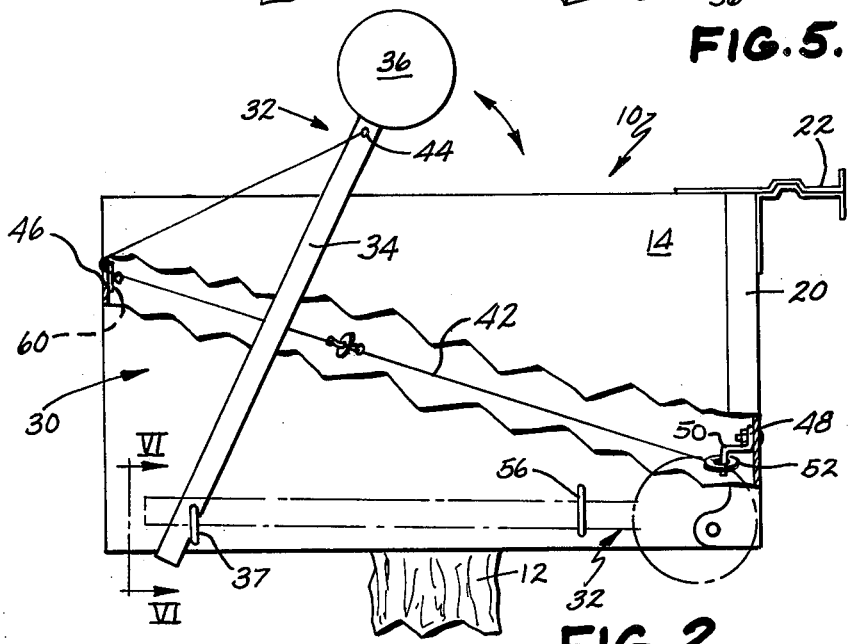
FIG. 2 is a side elevation of another typical rural mailbox with portions broken away to reveal the installation of the present signaling device to a side portion of that mailbox.

As shown in FIGS. 1 and 2, the mailbox signaling device 30 of the present invention may be mounted either on the rear or back surface 16 of the mailbox or on one of the side surfaces 14 thereof. In either case, the structure of the device, which is typically provided in kit form and installed by the individual owner of the mailbox, remains the same with the various elements merely being positioned differently along the side or back. Signaling device 30 includes a signaling member 32 having an elongated bar or stem 34 on one end of which is secured a circular disc 36 preferably painted with high visibility orange or red paint to facilitate viewing. Signaling member 32 is pivotally secured at the end opposite disc 36 by a pivot member 37 secured through the back or side surface of the mailbox into the wooden base 24 as is best seen in FIGS. 1, 2, 4 and 6. Preferably, the pivot member is a U-shaped member having the legs of the U embedded in the bottom 24 through the side or rear portion.

Stem 34 includes an aperture 38 therethrough adjacent the end opposite the disc 36 through which is received the upper leg 39 of the pivot member before it is secured into the base 24. The signaling member, therefore, can pivot or rotate about leg 39 in aperture 38 in a radius equivalent to the distance from aperture 38 to the end of the disc as will be seen from either FIG. 1 or 2. The lower leg 40 of pivot member 37 extends beyond the side edge of the bar or stem and provides a stop or limit which engages the side surface of the bar or stem as it is rotated towards the vertical position. Leg 40 limits the vertical pivotal movement of the signaling member and prevents it from pivoting over center or over vertical. This is important especially when the signaling device is mounted as shown in FIG. 1 if the box is closely adjacent another mailbox including a similar signal. Without the lower leg 40 preventing over-vertical pivoting, the signaling member 32 could fall to the right in FIG. 1 and trigger the accidental release of the adjacent signaling member even through the mailbox door on the adjacent box had not been opened, and no mail had been delivered.

Control of the pivotal movement of the signaling member 32 from its raised, nearly vertical position (as shown in solid in FIGS. 1 and 2) to its fallen or down position (shown in phantom in FIGS. 1 and 2) is obtained via an elongated, flexible connector member or control cord and a securing means which releases that cord upon opening of the door 20. As shown in either FIG. 1 or 2, connector member or control card 42 is secured to an aperture 44 adjacent disc 36 at the upper end of the signal member 32. The control cord, which is preferably flexible, wear resistant and formed typically from a woven fabric material, extends from the signaling member through an aperture 46 formed in the rear surface of the mailbox and into the interior of the mailbox. It extends through the interior to a releasable connection at the inside surface of the door closure 20.

The releasable connection preferably includes a bracket 48 secured to the inside surface of door 20 via a bolt, adhesive or other securing means. Bracket 48 includes a rod-like projection 50 extending first outwardly away from the inside door surface and then downwardly toward the pivot axis of the door. The end of the flexible connector 42 includes a rigid, ring-like washer or other loop member 52 secured to the end thereto. As the door closure is swung to its closed position, the operator of the signal pulls the cord toward the door such that the signaling member is raised to its upper, visible position with at least a portion of the stem 34 and the disc 36 being visible above the top or roof 18 of the mailbox. The ring-like washer 52 is slipped over the downwardly extending projection 50 as the door is closed, and the door is secured closed with latch 22. Pivoting of the signaling member 32 beyond the vertical is prevented by contact between the side edge of the stem 34 and lower leg 40 which also prevents a strong wind from blowing the signaling member over the vertical.

If desired, a spring 54 (FIG. 6) may be inserted over leg 39 between the side surface 14 of the mailbox and the inside surface of stem 34 to bias the stem outwardly and resiliently against the closed end of the U-shaped pivot member 37. Such spring exerts a bias on the signaling member thereby maintaining the control cord or connecting member 42 taut when ring 52 is slidably inserted over projection 50.

Figure 3:
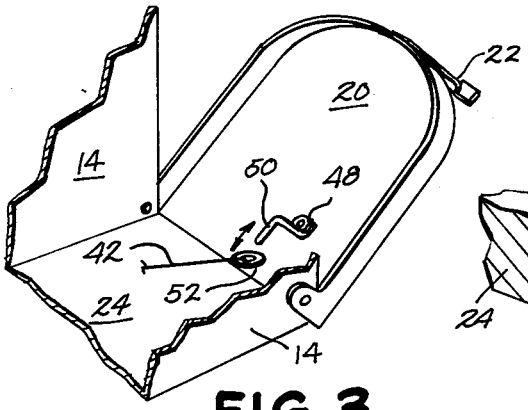
FIG. 3 is a fragmentary, perspective view of a portion of the interior of a mailbox including the present invention illustrating the means for releasing the flexible connector when the mailbox door is opened.
Figure 4:
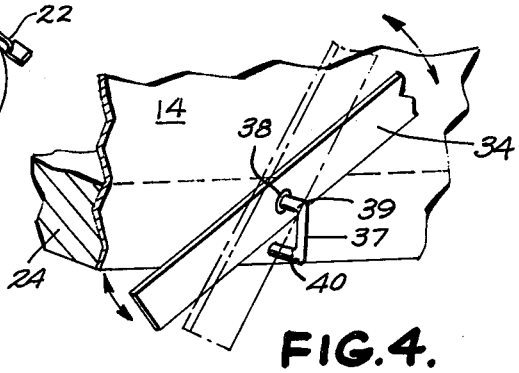
FIG. 4 is a fragmentary, perspective view of the pivotal securement of the signaling member to the mailbox in a manner which prevents rotation of the member past the vertical.

As the door is opened as shown in FIG. 3, ring member 52 slides downwardly off the projection 50 releasing the control cord which then slides through aperture 46 and allows signaling member 32 to pivot downwardly in its pivot arc. of course, other types of release members can be used to release cord 42 when door 20 is opened. A rest member 56 is screwed into the wooden base 24 through side 14 somewhere along the radius of the arc through which the signaling member falls. Member 56 provides a support for the signaling member in its lowered position and includes a vertically upwardly extending portion or flange 58 which prevents the stem of the signaling member from being moved laterally off the support in its lowered position.

In order to prevent a large impact force from being exerted by the signaling member as it falls against rest member 56, an abutment member comprising a rigid ring or washer 60 is tied or secured at a precise position along the control cord 42 as shown in FIGS. 1 and 2. In the raised position of the signaling member, abutment ring 60 is positioned within the interior of the mailbox intermediate the end 16 and door 20. However, as the signaling member is released as described above by the sliding of ring 52 off projection 50 as the door is opened, the sliding movement of control cord 42 through aperture 46 brings the ring 60 into abutment with the inside rear surface of the mailbox. The ring 60 is located to make such contact immediately prior to the contact between stem 34 and rest member 56 which lessens the impact force and prevents the stem from bouncing on the rigid support 56 and thereby prevents damage to the apparatus. Ring 60 is secured along cord 46 by tying on either side or around and through its central aperture so that the ring cannot move from its predetermined position along the cord.

Preferably, aperture 46 is rounded to prevent fraying or wearing of the control member 42 during repeated operation of the signal. Further, slidable release members including bracket 50 and release ring 52 are preferably formed from metallic materials to resist wear. It will be understood that the corner of the mailbox around which the cord 42 extends at least as shown in FIG. 2 is also rounded to prevent wear. Accordingly, since the cord extends through the interior of the mailbox and the release means are sheltered within the box, repeated operation even in severe and winter conditions is assured making the device extremely reliable.

The control cord 42 has a length and strength sufficient such that, in the raised position, the stem extends substantially above the roof of the box with disc 36 painted in high visibility paint and being easily visible by the owner of the mailbox. Since the stem 34 has a substantial length, the radius through which the signal swings is quite large making the lowered or down position of the signal also substantially easy to distinguish from the raised position. Accordingly, the device is highly visible. The abutment member 60 on the control cord prevents damage from repeated operation due to the contact of the signaling member 32 with the support 56 for its lowered position. Further, pivot 37 being substantially U-shaped, prevents undesired pivoting of member 32 over vertical and also prevents accidental triggering of signaling devices on adjacent boxes.

When assembled, the control cord is typically positioned along one side of the interior of the box so that insertion of large packages and mail is not obstructed. Moreover, the release bracket 48 is typically secured toward the lower portion of the door with aperture 46 being a larger distance above the bottom of the box than the bracket 48. Aperture 44 in stem 34 is yet a further distance above the bottom at least when the signal is in its raised position. Accordingly, the control cord extends on an upward incline in the preferred embodiment from the release bracket 48 through aperture 46 to the securement point adjacent the top or upper end of the signaling member when member 32 is raised. Also aperture 46 is located intermediate pivot 37 and attachment point 44 on stem 34. These positions facilitate the leverage of the operator of the device when the signal is pulled to its raised position and ring 52 is secured over the bracket projection 50.

The device is preferably sold in kit form including the signaling member 32, a sufficient length of control cord 42, pivot member 37 releasing securing bracket 48 and attachment means therefor, rest member 56, and abutment member 60. Spring 54 may also be included. The elements are thereafter assembled by the purchaser on his own mailbox either in the rear position as shown in FIG. 1 or the side position as shown in FIG. 2 to provide the reliable, simply operated mailbox signal described above. Should door 20 be, in fact, pivoted around an axis at the top of the mailbox, the projection on securing bracket 48 would be oppositely positioned, that is, upwardly so that upward pivoting of the door or opening would likewise release ring 52 to allow downward movement of the mailbox signal to indicate that the door had been opened. Thus, in either case, the securing bracket 48 is positioned a short distance from the pivot axis of the door with the projection 50 having its free end extending toward that pivot axis so that it points toward the control cord for release in the open position.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A mailbox signaling device for inclusion on a receptacle for receiving mail of the type having top, side, end and bottom portions and a closure movably mounted over an aperture in the receptacle for access to the receptacle interior, said device comprising a signaling member having a signal portion at one end thereof; pivot means for pivotally securing said signaling member to one portion of a mail receptacle of the stated type; elongated, flexible connecting means having opposite ends for extending through the interior of the mail receptacle and outwardly of the receptacle for connection to said signaling member; means for mounting said connecting means for sliding movement including an aperture in the mail receptacle which opens from the interior to the exterior thereof; first means for attaching one of said ends of said connecting means to said signaling member at a location spaced along said signaling member from said pivot means; and second means for releasably securing the other of said ends of said connecting means to an interior surface of the receptacle closure such that said other end will be released when the closure is moved to its open position; said flexible connecting means extending from said closure through said receptacle interior, said aperture and connected to said location on said signaling means with said first means and having an overall length and strength sufficient to hold said signaling member in a raised, visible position such that at least a portion thereof is visible above the top of said receptacle when said releasable second means is secured to said interior surface of the closure and the closure is in its closed position, said raised, visible position being such that release of said second means from said closure will cause said signaling member to drop by gravity to a lower fallen position while pulling a portion of said flexible connecting means through said aperture, whereby opening the closure releases said second means and connecting means and allows said signaling means to pivot downwardly to a fallen position indicating the closure has been opened.

2. The mailbox signal of claim 1 wherein said connecting means has a length sufficient to hold said signaling member upright on said pivot means at an angle to the vertical when said second means is secured to said interior closure surface and said closure is in its closed position.

3. The mailbox signal of claim 1 wherein said aperture extends through a portion of the mail receptacle above the bottom of the receptacle.

4. The mailbox signal of claim 3 wherein said aperture is positioned in receptacle opposite to said second means.

5. The mailbox signal of claim 1 including a rest member secured to the mail receptacle exterior along the pivot arc through which said signaling member rotates when released, said rest member adapted to contact and support said signaling member in its down or fallen position.

6. The mailbox signal of claim 5 including abutment means on the portion of said connecting means positioned interior of the receptacle between said closure and said aperture, said abutment means being positioned to engage an interior surface of the receptacle immediately prior to contact between said signaling member said rest member whereby bouncing of said signaling member on said rest member and any damage thereto is prevented.

7. The mailbox signal of claim 5 wherein said rest member includes a vertically extending portion spaced outwardly from the exterior surface of the receptacle to prevent lateral movement of said signaling member off said rest member in its down or fallen position.

8. The mailbox signal of claim 1 wherein said second means include a securing bracket fixed to the interior surface of the receptacle closure, said bracket including a projection extending from said interior closure surface; said connecting means including slide means at its other end for slidably engaging said projection whereby when said closure is opened, said slide means will slide off said projection and release said signaling member to fall to its down position.

9. A mailbox signaling device for inclusion on a receptacle for receiving mail of the type having top, side, end and bottom portions and a closure movably mounted over an aperture in the receptacle for access to the receptacle interior, said device comprising a signaling member having a signal portion at one end thereof; pivot means for pivotally securing said signaling member to one portion of a mail receptacle of the stated type; elongated flexible connecting means having opposite end for extending through the interior of a mail receptacle; means for mounting said connecting means for sliding movement through one portion of a mail receptacle from the interior to the exterior thereof; first means for attaching one of said ends of said connecting means to said signaling member at a location spaced along said signaling member from said pivot means; and second means for releasably securing the other of said ends of said connecting means to an interior surface of the receptacle closure such that said other end will be released when the closure is moved to its open position; said connecting means having an overall length and strength sufficient to hold said signaling member in a visible position such that at least a portion thereof is visible above the top of said receptacle when said releasable second means is secured to said interior surface of the closure and the closure is in its closed position whereby opening the closure releases said connecting means and allows said signaling means to pivot downwardly to a fallen position indicating the closure has been opened; said second means including a securing bracket fixed to the interior surface of the receptacle closure, said bracket including a projection extending from said interior closure surface; said connecting means including slide means at its other end for slidably engaging said projection whereby when said closure is opened, said slide means will slide off said projection and release said signaling member to fall to its down position; said closure being pivotable downwardly for opening; said slide means including a ring member with an aperture therethrough secured to said connecting means; said projection extending outwardly and downwardly from said interior closure surface and being smaller than said aperture and adapted to slidably receive said ring member thereover from below as said closure is closed.

10. A mailbox signaling device for inclusion on a receptacle for receiving mail of the type having top, side, end and bottom portions and a closure movably mounted over an aperture in the receptacle for access to the receptacle interior, said device comprising a signaling member having a signal portion at one end thereof; pivot means for pivotally securing said signaling member to one portion of a mail receptacle of the stated type; elongated flexible connecting means having opposite ends for extending through the interior of a mail receptacle; means for mounting said connecting means for sliding movement through one portion of a mail receptacle from the interior to the exterior thereof; first means for attaching one of said ends of said connecting means to said signaling member at a location spaced along said signaling member from said pivot means; and second means for releasably securing the other of said ends of said connecting means to an interior surface of the receptacle closure such that said other end will be released when the closure is moved to its open position; said connecting means having an overall length and strength sufficient to hold said signaling member in a visible position such that at least a portion thereof is visible above the top of said receptacle when said releasable second means is secured to said interior surface of the closure and the closure is in its closed position whereby opening the closure releases said connecting means and allows said signaling means to pivot downwardly to a fallen position indicating the closure has been opened; said pivot means including a U-shaped member with the legs thereof aligned generally vertically and embedded in said receptacle, said signaling member having a stem with an aperture therethrough with the uppermost of said legs of said U-shaped member received in said stem aperture to provide pivotal movement for said signaling member, said lowermost leg of said U-shaped member contacting an extending portion of said stem to limit said signaling member from pivoting past a vertical position when it is raised.

11. The mailbox signal of claim 3 wherein said second means are located a first distance above the bottom of a receptacle; said aperture being located a second distance above said bottom which is greater than said first distance; said first means located adjacent the end of said signaling member opposite said pivot means whereby said connecting means extends on an upward incline from said second means to said signaling member through said aperture.

12. The mailbox signal of claim 1 wherein said flexible connecting means is a continuous cord.

13. A kit for assembling a mailbox signal device on a receptacle for receiving mail, said receptacle being of the type including top, side, end and bottom portions and a closure movably mounted over an aperture in the receptacle for access to the receptacle interior, said kit comprising:

a signaling member for attachment to one portion of a receptacle of the defined type;

a pivot member for pivotally securing said signaling member to one portion of the mail receptacle such that said signaling member will swing from a raised to a lowered position;

an elongated, flexible connector having opposite ends;

first means for attaching one of said ends of said connecting means to said signaling member at a location spaced from the position on said signaling member at which said signaling member is adapted to be pivotally attached to the receptacle; and second means for releasably securing said other of said ends of said flexible connector to an inside surface of the receptacle closure, said second means including a projection member adapted to be secured to the inside surface of the receptacle closure and a loop member adapted to be secured to said other end of said flexible connector, said loop member adapted to be slidably received on said projection member when the receptacle door is closed and said signaling member is in its raised position;

said flexible connector having an overall length sufficient to extend from said inside closure surface through an aperture in one portion of said receptacle on which the kit is to be installed to said signaling member in its raised position whereby, when said signaling member is pivotally secured on said pivot member to a mail receptacle with said flexible connector secured to said signaling member with said first means, extending through the provided aperture in the receptacle and slidably secured to said closure with said projection and loop members, said signaling member will be held in its raised position until said closure is opened which allows said loop member to slide off said projection member to release said connector thereby allowing the signaling member to swing to its lowered position.

14. The kit of claim 13 including a rest member for securement to the mail receptacle in the path of swing of said signaling member to support that member in its lowered position.

15. The kit of claim 14 including an abutment member for attachment to said flexible connector at a position therealong adapted to contact a portion of the receptacle adjacent the aperture therein through which the connector passes immediately before said signaling member contacts said rest member to reduce the impact force of such contact.

16. The kit of claim 13 including means on said pivot member for preventing said signaling member from pivoting past a predetermined raised position when pivoted upwardly thereon.

17. The mailbox signal of claim 1 wherein said pivot means include a pivot axle member embedded in said receptacle, said signaling member having a stem with an aperture therethrough, said pivot axle being received in said stem aperture to provide pivotal movement for said signaling member, and a pivotal movement limiting member positioned on said receptacle adjacent said pivot axle member for contacting a portion of said stem to limit said signaling member from pivoting past the position of said limiting member when it is raised.

18. The mailbox signal of claim 1 including abutment means on a portion of said flexible connecting means positioned interior of the receptacle between said closure and said aperture, said abutment means positioned along said connecting means to engage a portion of said receptacle to limit downward pivotal movement of said signaling member.

* * * * *

UNITED STATES PATENT AND TRADEMARK OFFICE

CERTIFICATE OF CORRECTION

PATENT NO. : 4,073,430

DATED : February 14, 1978

INVENTOR(S) : ALBERT P. JORIS

It is certified that error appears in the above-identified patent and that said Letters Patent are hereby corrected as shown below:

Column 3, Line 50:

"through" should be --though--.

Column 4, Line 34:

"of" should be --Of--.

Column 5, Line 7:

After "winter" please insert --weather--.

Column 6, Line 56:

After "in" please insert --the--.

Column 9, Line 11:

After "aperture" please insert --provided--.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*